United States Patent [19]

Rosen

[11] Patent Number: 4,848,246

[45] Date of Patent: Jul. 18, 1989

[54] CRIME PREVENTION MARKING SYSTEM

[76] Inventor: Leon Rosen, 1919 Chestnut St., Apt. 2312, Philadelphia, Pa. 19103

[21] Appl. No.: 248,003

[22] Filed: Sep. 22, 1988

[51] Int. Cl.[4] ..... E05G 3/00

[52] U.S. Cl. ..... 109/25; 109/29

[58] Field of Search ..... 109/20, 25, 29; 2/159, 2/160; 40/1, 586; 239/154

[56] References Cited

U.S. PATENT DOCUMENTS

| | | | |
|---|---|---|---|
| 1,885,180 | 11/1932 | Cameron | 109/29 |
| 4,370,696 | 1/1983 | Darrell | 2/160 |
| 4,442,780 | 4/1984 | Child | 109/29 |
| 4,728,037 | 3/1988 | Mainhardt | 239/154 |
| 4,768,681 | 9/1988 | Dean | 2/160 |

OTHER PUBLICATIONS

"Spray Brands Pure Snatcher", Oct. 1959, Popular Science, p. 97.

*Primary Examiner*—Robert L. Wolfe

*Attorney, Agent, or Firm*—Caesar, Rivise, Bernstein, Cohen & Pokotilow

[57] ABSTRACT

A device for applying a predetermined color coded identification marking onto a perpetrator of a crime. The device is a glove to be worn on the hand of the victim and includes plural color applicators located on respective finger tips of the glove. Each applicator applies a respectively colored dye onto the perpetrator when the applicator is brought into contact with him/her. Thus, a plurality of different colored markings are left on the perpetrator. This can facilitate his/her apprehension and identification. The dyes can be provided to the applicators via conduits from respective reservoirs or may be microencapsulated in beads on the glove's finger tips.

14 Claims, 3 Drawing Sheets

FIG. 1
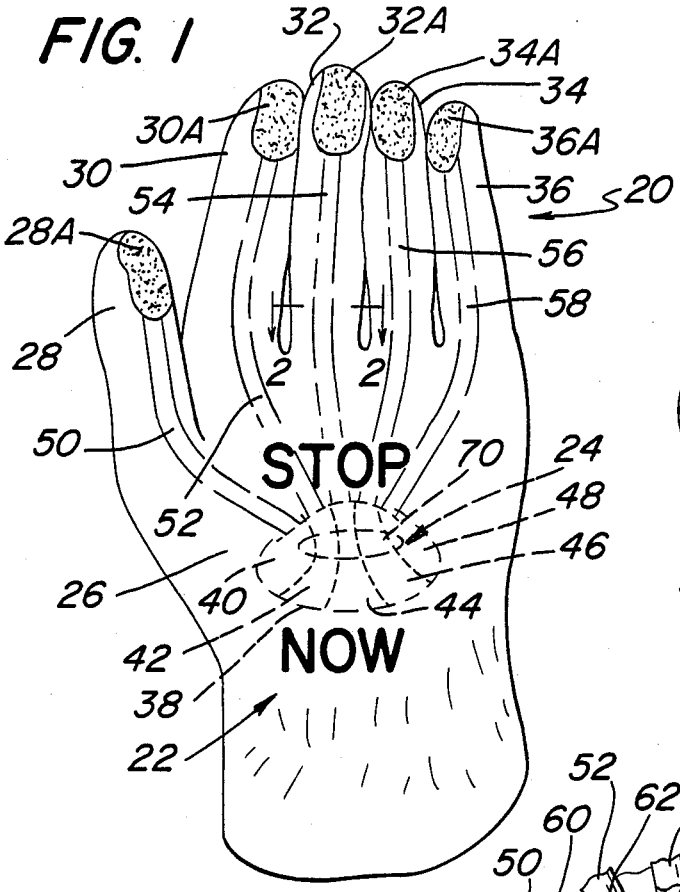
FIG. 2
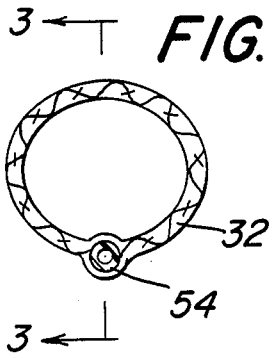
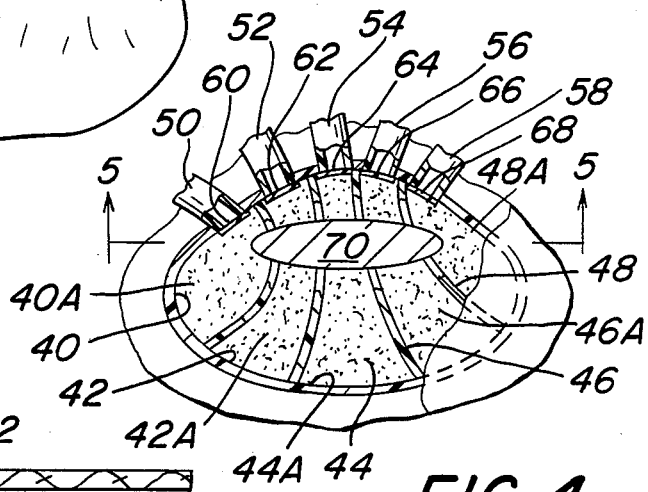
FIG. 4
FIG. 3
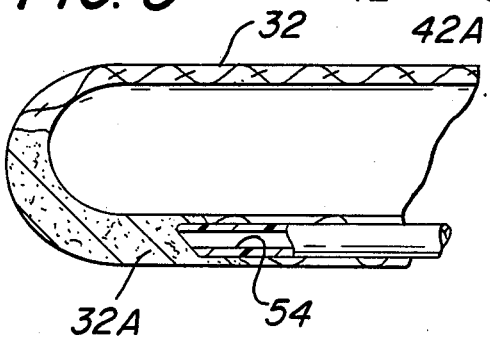

FIG. 5
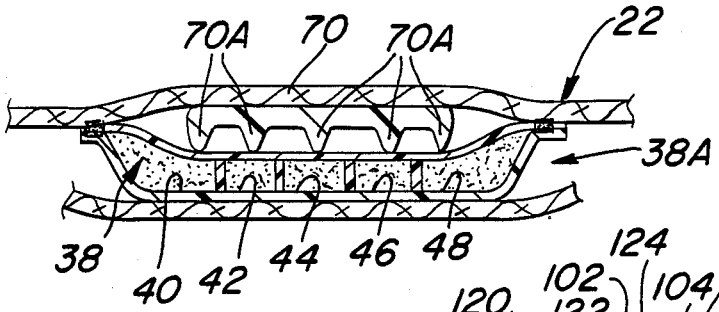
FIG. 7
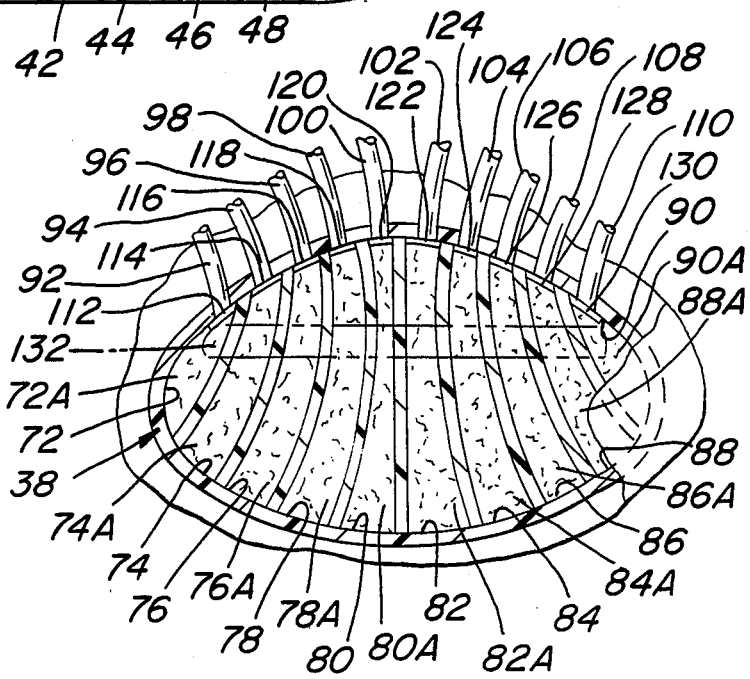
FIG. 6
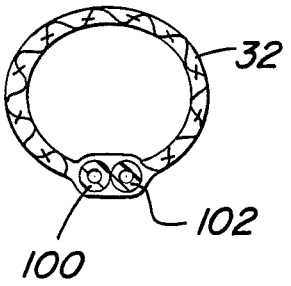
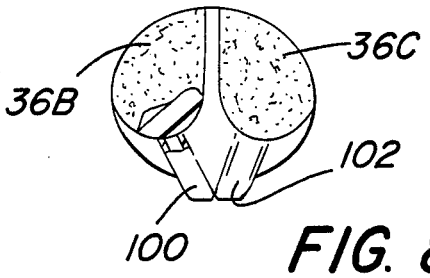
FIG. 8

CRIME PREVENTION MARKING SYSTEM

BACKGROUND OF THE INVENTION

This invention relates generally to marking devices and more particularly to devices for marking persons with identifying indicia.

As is generally known the incidence of crimes against the person, such as muggings, has reached epidemic proportions, particularly in large metropolitan areas. Part of the reason for the increased incidence of such crimes is the fact that law enforcement resources are overburdened. Thus, those persons having the propensity to commit such crimes know that their chance of identification and apprehension is low.

OBJECTS OF THE INVENTION

Accordingly, it is a general object of this invention to provide a device which can effect the marking of a perpetrator of a crime with identifiable indicia.

It is a further object of this invention to provide an easy to operate device that can be used by a person to apply a color coded marking to a perpetrator of a crime.

It is still a further object of this invention to provide a device which is arranged to be worn on the hand and which is readily actuatable to apply a uniquely color coded marking onto a perpetrator of a crime during the commission of that crime.

It is yet a further object of this invention to provide a device which has the aesthetically pleasing appearance of a conventional glove but which is arranged for marking a perpetrator of a crime with uniquely color coded indicia.

It is yet a further object of this invention to provide a device arranged to be worn on the hand of a person which bears indicia warning the perpetrator of a crime that contact by the device will mark the perpetrator to facilitate his/her identification and apprehension.

SUMMARY OF THE INVENTION

These and other objects of this invention are achieved by providing a device for applying a predetermined identification marking onto a perpetrator of a crime. The device comprises covering means, arranged to be worn on the hand of the victim of the crime, and color application means mounted on the covering means. The color application means comprises a plurality of applicators, each of which is located on the covering means adjacent a respective finger tip on the palm side of the hand of the victim. Each applicator is arranged to apply a respectively colored, marking agent, e.g., dye, onto the perpetrator when said applicator is brought into contact with any portion of the perpetrator, whereupon a plurality of different colored markings are left on the perpetrator to facilitate the apprehension and identification of that perpetrator.

In accordance with all the preferred embodiments of the invention shown herein the covering means comprises a glove-like member which is worn on the hand of the person to be protected.

In accordance with a few of such embodiments the application means comprises respective absorbent pads located on the fingertips of the glove, plural easily rupturable reservoirs containing liquid marking (coloring) agents therein, and associated conduits for carrying the coloring agents to the applicator pads. In another embodiment each applicator pad includes its own easily rupturable coloring agent reservoir therein. In yet other embodiments the applicators are made up of a multitude of easily rupturable, microencapsulated, coloring agent-containing, beads located directly on the fingertips of the glove or within absorbent pads located on the fingertips of the glove.

DESCRIPTION OF THE DRAWINGS

Other objects and many attendant features of this invention will become readily appreciated as the same becomes better understood by reference to the following detailed description when considered in connection with the accompanying drawings wherein:

FIG. 1 is a plan view of the palm side of a glove-like device constructed in accordance with one aspect of this invention.;

FIG. 2 is an enlarged sectional view taken along line 2—2 of FIG. 1;

FIG. 3 is a sectional view taken along line 3—3 of FIG. 2;

FIG. 4 is an enlarged plan view, partially in section, showing a portion of the device of FIG. 1;

FIG. 5 is an enlarged sectional view taken along line 5—5 of FIG. 4;

FIG. 6 is a sectional view similar to that of FIG. 2 but of an alternative embodiment of this invention;

FIG. 7 is an enlarged plan view, similar to that of FIG. 4, but of another portion of the alternative embodiment of the invention shown in FIG. 6;

FIG. 8 is an end view of the fingertip portion of the alternative embodiment of the invention shown in FIGS. 6 and 7;

DETAILED DESCRIPTION OF THE PREFERRED EMBODIMENTS

Figure 9:
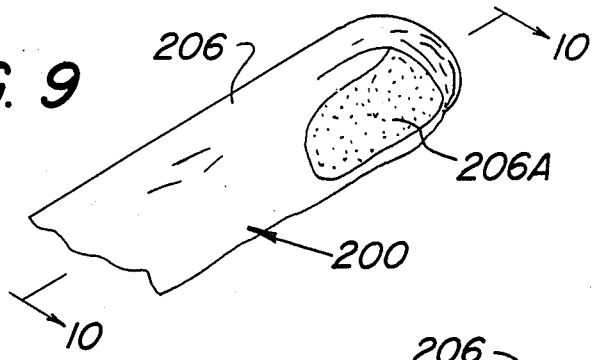
FIG. 9 is a perspective view of the fingertip portion of yet another embodiment of this invention.

Referring now to various figures of the drawing where like reference numerals refer to like parts there is shown at 20 in FIG. 1 one embodiment of the device of the subject invention. It must be pointed out at this time that while the embodiment of the device shown in FIG. 1 (as well as the other embodiments of the invention as shown in the remaining figures) is in the form of a glove, i.e., a hand covering having separate finger containing portions, it can take other forms as well, e.g., a mitten, a half glove (i.e., a glove whose finger tips are open), etc. All that is necessary is that the device be capable of being worn on the hand of a person to be protected and include actuatable means (to be described later), which when actuated will apply a color marking onto the perpetrator of a crime against the person protected. The color coded marking can serve to identify the perpetrator of the crime and thus aid in his/her apprehension and conviction.

The device 20 basically comprises the heretofore mentioned glove 22 and color application means 24. The glove 22 is of conventional construction and aesthetic appearance, save for the inclusion of the color application means 22 and optional warning indicia (to be described later). Thus, the glove 22 includes a palm portion 26 from which project five finger receiving portions, namely, thumb receiving portion 28, index finger receiving portion 30, middle finger receiving portion 32, ring finger receiving portion 34, and little finger receiving portion 36. A respective applicator pad is disposed on the palm side of each of the finger portions contiguous with the free end (fingertip) thereof. Thus, portion 28 includes applicator 28A, portion 30 includes applicator 30A, portion 32 includes applicator 32A, portion 34 includes applicator 34A, and portion 36 includes applicator 36A. Each of the applicators is a pad-like member formed of an absorbent material, e.g., paper, a woven or knitted fabric, an open cell foam, etc., which is secured to the material making up the glove 22. The securement of the pads to the glove can be accomplished by sewing, adhesives or any other suitable means.

Each applicator pad is arranged to have a coloring agent, e.g., dye, provided thereto when desired (when the device is actuated, as will be described later) to cause the pad to absorb that coloring agent over substantially its entire surface. Any suitable dye or coloring agent can be employed in this invention, so long as it does not dry quickly and is easily transfered to anything which it contacts. Accordingly, when the pad with the absorbed, yet transferrable, dye is brought into even slight contact with a portion of the body of a perpetrator of a crime, the dye is applied to that body portion.

In all of the preferred embodiments of the invention each dye is selected to be color fast, long lasting and resistant to ready removal. This feature ensures that once a perpetrator is marked with the dyes, he/she cannot readily remove the marking to avoid identification.

In the embodiment of FIGS. 1–5 and 9–12 each device is arranged to apply five colors to the perpetrator, while the embodiment of FIGS. 6–8 is arranged to apply ten colors to the perpetrator. As should be appreciated by those skilled in the art even if only five different basic colors (e.g., red, blue, yellow, green, white) are used a great number of color combinations are possible, depending upon the order of those colors in the marking applied to the perpetrator. Obviously, if various shades of basic colors are used, the number of distinguishable combinations can be increased by several orders of magnitude.

Thus, the subject invention provides a means of tagging a perpetrator of a crime with a substantially uniquely color coded marking. This marking can materially assist law enforcement officers in the identification, apprehension and conviction of the perpetrator. Moreover, and perhaps more significantly is the deterrent effect provided to the wearer of any device constructed in accordance with this invention, since the would-be perpetrator is likely to think twice about omitting the crime, knowing that it is likely that he/she is liable to be marked.

As can be seen in FIGS. 4 and 5 the dyes that are provided to the pads are stored in a reservoir assembly 38 mounted in a pocket 38A in inside of the palm portion 26 of the glove 22. The reservoir assembly 38 comprises a plurality of individual reservoirs or chambers 40, 42, 44, 46, and 48 storing dyes 40A, 42A, 44A, 46A, and 48A, respectively, therein. As mentioned earlier each of the dyes is a different color. Each reservoir is connected by a respective conduit to an associated applicator pad to carry the dye within the chamber to its associated applicator pad. Thus, chamber 40 is connected to applicator pad 28A via conduit 50, chamber 42 is connected to applicator pad 30A via conduit 52, chamber 44 is connected to applicator pad 32A via conduit 54, chamber 46 is connected to applicator pad 34A via conduit 56, and chamber 48 is connected to applicator pad 36A via conduit 58. Each of the conduits is located within the glove and extends along the finger on the palm side of the hand. The diameter or thickness of the conduits is kept small in the interests of aesthetics.

As can be seen in FIG. 4 a rupturable wall is disposed at the end of each conduit where it meets its associated chamber, to isolate the dye in the chamber from the conduit until the dye is to be transferred to the applicator for marking a perpetrator. Thus, a rupturable wall 60 is located at the interface of chamber 40 and conduit 50, a rupturable will 62 is located at the interface of chamber 42 and conduit 52, a rupturable wall 64 is located at the interface of chamber 44 and conduit 54, a rupturable wall 66 is located at the interface of chamber 46 and conduit 56, and a rupturable wall 68 is located at the interface of chamber 48 and conduit 58.

In order to effect the simultaneous rupturing of all of the chambers and to move the dyes stored therein through the conduits to the associated applicator pads, the assembly 24 includes an actuator plate 70 (FIG. 5). The plate 70 is a generally planar member which is disposed in a inner pocket 38A of the glove's palm portion and over the chambers 40–48. The plate 70 includes five downwardly extending projections 70A, each of which is located over a respective chamber 40–48 of the assembly 38. Each projection is arranged to force the dye through the rupturable wall of the associated chamber, into the associated conduit and to the associated applicator pad, when a force is applied to the top of the plate 70. Such action occurs when the wearer of the device 20 wishes to arm the device for perpetrator marking purposes. That action can occur in various ways. For example, the wearer of the device could press downward on the plate 70 with his/her other hand. Alternatively, the wearer can merely bring the palm side of his/her hand on which the device 20 is disposed into sharp engagement with the perpetrator. Either action causes the pressure applied to the dye chambers to force the dyes through their respective rupturable walls, into their associated conduits and applicator pads. Thus, any contact of the applicator pads to the perpetrator will transfer the dyes onto him/her.

As should be appreciated by those skilled in the art, the amount of force necessary to effect the rupture of the walls 60–68 is selected to be low enough that the device can be actuated readily for marking a perpetrator, yet is sufficiently high that normal pressure applied to the palm portion will not cause the accidental release of the dyes. Moreover, in the interests of preventing accidental release of the dyes the assembly 38 may be located in a pocket on the opposite side of the hand than the palm. In such a case the conduits will extend along the fingers on that side of the hand.

If desired the device 20, or any other device constructed in accordance with this invention, may contain some indicia thereon, such as a warning to the perpetrator to stop (see FIG. 1).

The embodiment of the device shown in FIGS. 6–8 is basically the same as that of device 20 shown in FIGS. 1–5 except that the alternative embodiment includes ten applicator pads and ten dye containing chambers. Two applicator pads are located at the tip of each finger portion of the glove (See FIG. 8 where applicator pads 36B and 36C are located at the tip of finger portion 36). Each applicator pad is constructed similarly to the pads described heretofore. The ten dye holding chambers are identified as 72, 74, 76, 78, 80, 82, 84, 86, 88, and 90. Each contains a respectively colored dye 72A, 74A, 76A, 78A, 80A, 82A, 84A, 86A, 88A, and 90A. Ten conduits 92, 94, 96, 98, 100, 102, 104, 106, 108, and 110 are connected between the chambers 72, 74, 76, 78, 80, 82, 84, 86, 88, and 90, respectively, and the associated applicator pads (only two of which, 36B and 36C, are shown). Respective rupturable walls 112, 114, 116, 118, 120, 122, 124, 126, 128, and 130 are located at the ends of conduits 92, 94, 96, 98, 100, 102, 104, 106, 108, and 110, respectively, and serve the same function as described heretofore with reference to walls 60–68. An actuator plate 132, having ten downwardly extending projections (not shown) serves the same purpose as plate 70 described heretofore.

Figure 10:
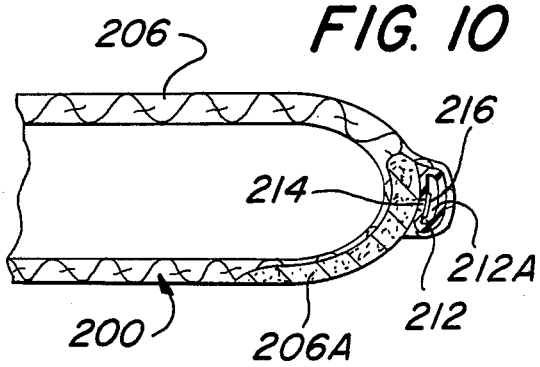
FIG. 10 is a sectional view taken along line 10—10 of FIG. 9.

FIGS. 9 and 10 show a fingertip portion of yet another alternative embodiment of this invention. In that embodiment, designated by the reference number 200, the color application means does not include the heretofore described reservoir assembly 38 and associated conduits 50–58. Thus, in the glovelike device 200 only includes the finger-tip mounted applicator pads, only one of which, 206A, is shown. Each applicator pad includes its own dye holding reservoir located directly thereon. Thus, as can be seen clearly in FIGS. 10 and 11 the applicator pad 206A (which is identical to the other applicator pads—not shown) is made up of an absorbent material portion, like that described with reference to the applicator pads of device 20, and an associated chamber 212. The chamber 212 is located within a pocket at the tip of the applicator pad and is a hollow, flexible member formed of any suitable material, e.g , rubber or plastic. A respectively colored dye 212A is located within the chamber. The chamber includes an outlet 214 to the pad and which is covered by a rupturable wall 216. The wall 216 is arranged to be ruptured by the application of force onto the chamber. This action causes to dye 212A in the chamber to exit through the outlet 214 into the pad where it is absorbed and ready to be transferred to the perpetrator upon contact therewith.

Figure 11:
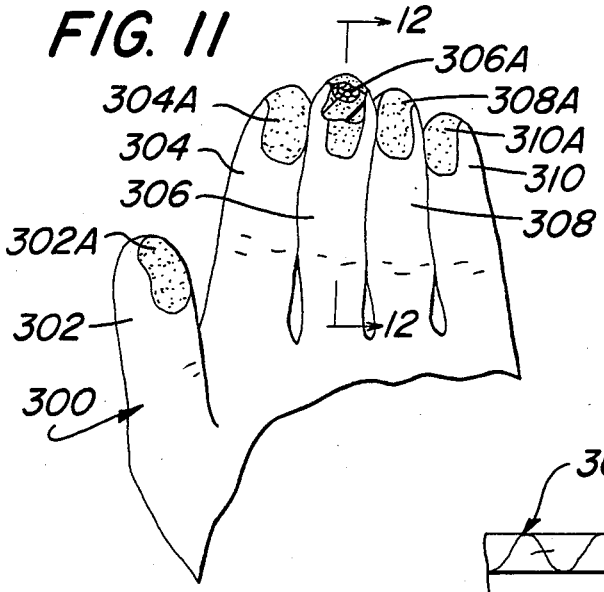
FIG. 11 is a plan view of a portion of still another embodiment of this/invention.
Figure 13:
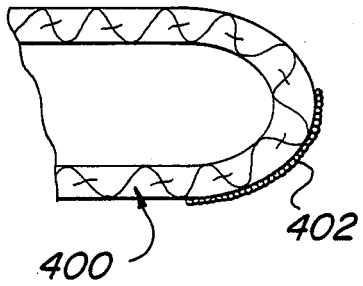
FIG. 13 is a view similar to that of FIG. 12 of yet still another embodiment of this invention.
Figure 12:
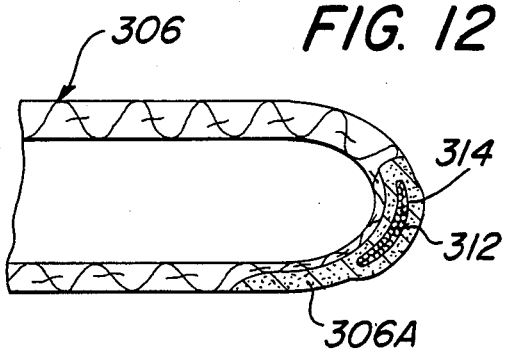
FIG. 12 is a enlarged sectional view take along line 12—12 of FIG. 11.

In FIGS. 11, 12 and 13 there are shown yet two other embodiments, 300 and 400, of this invention. Both embodiments are similar in concept to embodiment 200, ;n that they obviate the need for a central reservoir assembly and associated conduits. In addition they also obviate the need for liquid-dye containing chambers located at each finger tip. Thus, one embodiment 300 (FIGS. 11 and 12) makes use of a glove having finger portions 302, 304, 306, 308 and 31n, having applicator pads 302A, 304A, 306A, 308A, and 310A, respectively, located at the tip portions thereof (like that described heretofore). Each applicator pad includes a plurality of dye-containing (e.g., microencapsulated), beads 312 located within a respective pocket 314 adjacent the finger tip end of the applicator pad. The beads on each finger tip are easily rupturable by the application of a predetermined force thereto. The force is sufficiently low as to enable the easy rupturing of the beads to release the dye contained therein but is high enough that the beads don't break upon normal contact therewith in order to prevent accidental release of the dye. Each pad is similar in construction to those described heretofore. Thus, when the beads 312 are ruptured the dye in the beads leaks out and is absorbed by the applicator pad, so that the pad is ready to apply the dye to the perpetrator in the same manner as described heretofore.

In the embodiment 400 (FIG. 13), a plurality of microencapsulated dye containing beads 402 located directly on the finger tip of each finger portion of the glove. As will be appreciated this embodiment 300 thus eliminates the need for applicator pads, in addition to eliminating the need for reservoirs and conduits.

As should thus be appreciated by those skilled in the art the devices of this invention are simple in construction, can be made so that they have a conventional aesthetically pleasing appearance, yet are extremely effective and easy to use to mark a perpetrator of a crime with identifying markings.

Without further elaboration the foregoing will so fully illustrate my invention that others may, by applying current or future knowledge, readily adapt the same for use under various conditions of service.

I claim:

1. A device for use by a victim of a crime for applying a predetermined identification marking onto a perpetrator of the crime to facilitate the apprehension and identification of said perpetrator, said victim having a hand, said device comprising covering means arranged to be worn on the hand of the victim of said crime and color application means, said color application means comprising a plurality of applicators, each of said applicators being located adjacent a respective finger tip on the palm side of the hand of said victim and being arranged to apply a respectively colored, coloring agent onto said perpetrator when said applicator is brought into contact with said perpetrator, whereupon a plurality of different colored markings are left on said perpetrator.

2. The device of claim wherein each of said applicators is arranged so that its associated coloring agent will not be applied accidentally to any object or thing which might be engaged by said applicator.

3. The device of claim 2 wherein each of said applicators comprises an absorbent material and wherein said color application means comprises a plurality of chambers, each including a respectively colored liquid coloring agent therein, and a plurality of respective conduits coupled between a respective chamber and a respective applicator.

4. The device of claim 3 wherein said chambers are arranged to be actuated by a predetermined force applied thereto to enable the liquid coloring agents therein to flow through their associated conduits to said applicators, whereupon said applicators will apply said coloring agents to anything which they engage.

5. The device of claim 4 wherein each of said chambers is rupturable when said force is applied thereto, whereupon the liquid coloring agent located therein exits said chamber and enters said associated conduit to flow to said associated applicator.

6. The device of claim 5 wherein said covering means comprises a glove.

7. The device of claim 2 wherein each of said applicators comprises an absorbent material, and wherein said color application means comprises a plurality of chambers, each located within a respective one of said applicators, each of said chambers being rupturable when a predetermined force is applied thereto so that the liquid coloring agent located therein exits said chamber and flows into its associated applicator, whereupon said applicators will apply said coloring agents to anything which they engage.

8. The device of claim 7 wherein said covering means comprises a glove.

9. The device of claim 2 wherein each of said applicators comprises a plurality of microencapsulated beads containing said liquid coloring agent therein, said beads being rupturable when a predetermined force is applied thereto so that the liquid coloring agent is released, whereupon said applicators will apply said coloring agents to anything which they engage.

10. The device of claim 9 wherein said covering means comprises a glove.

11. The device of claim 1 wherein said covering means comprises a glove.

12. The device of claim 11 wherein said glove includes indicia thereon for providing a warning to said perpetrator.

13. The device of claim 8 wherein said glove includes indicia thereon for providing a warning to said perpetrator.

14. The device of claim 10 wherein said glove includes indicia thereon for providing a warning to said perpetrator.

* * * * *